US006840399B2

(12) United States Patent
Chirnomas

(10) Patent No.: US 6,840,399 B2
(45) Date of Patent: Jan. 11, 2005

(54) METHOD AND APPARATUS FOR HOSE STORAGE IN AN ARTICLE HANDLING DEVICE

(76) Inventor: Munroe Chirnomas, 47 Skyline Dr., Morris Township, NJ (US) 07960

( * ) Notice: Subject to any disclaimer, the term of this patent is extended or adjusted under 35 U.S.C. 154(b) by 11 days.

(21) Appl. No.: 10/296,530

(22) PCT Filed: May 23, 2001

(86) PCT No.: PCT/US01/16846

§ 371 (c)(1),
(2), (4) Date: Nov. 23, 2002

(87) PCT Pub. No.: WO01/91071

PCT Pub. Date: Nov. 29, 2001

(65) Prior Publication Data

US 2003/0146234 A1 Aug. 7, 2003

(51) Int. Cl.[7] ..... G07F 1/00

(52) U.S. Cl. ..... 221/7; 221/278

(58) Field of Search ..... 221/2, 7, 9, 13, 221/150 R, 210, 211, 278; 414/797

(56) References Cited

U.S. PATENT DOCUMENTS 5,240,139 A * 8/1993 Chirnomas ..... 221/2

* cited by examiner

*Primary Examiner*—Kenneth Noland
(74) *Attorney, Agent, or Firm*—Lawrence C. Edelman, Esq.

(57) ABSTRACT

An article handling apparatus embodied, for example, as a vending machine, includes a controllably positioned hose dispenser for retrieving articles from an article storage area. A hose is continuous from a first end located within a hose storage area, where the hose receives article securing energy (e.g., suction), to a second end adapted to secure to and extract a selected article from the storage area. A hose positioning mechanism coupled to the hose controllably positions the second end of the hose so as to be aligned with a given article stored in the storage area, for controllably contacting and extracting the selected article from the storage area, and controllably positioning the second end of the hose so as to transport the article to a dispensing area. The hose positioning mechanism imparts both a storage requirement and a retraction requirement on the hose as a result of the controllable positioning. In accordance with the principles of the present invention a single hose storage area is provided in the vending machine for meeting all of the hose storage and retraction requirements.

19 Claims, 6 Drawing Sheets

METHOD AND APPARATUS FOR HOSE STORAGE IN AN ARTICLE HANDLING DEVICE

BACKGROUND OF THE INVENTION

1. Field of the Invention

The present invention relates generally to improvements in the design and operation of article handling apparatus and in particular to hose storage and retraction techniques useful in the environment of article handling devices that use a hose type of article gripping mechanism.

2. Description of the Prior Art

Most prior art article handling mechanisms, more specifically referred to in the description of the present invention as being in the environment of a point-of-sale (POS) article dispenser, rely on a multitude of motors, switches and solenoids for moving various portions of the handling mechanism, and handling of the articles themselves, such as packaged products. Most such machines require one motor, switch and/or solenoid dedicated for each row, column or type of article or package to be handled or dispensed therefrom. Such machines generally suffer from numerous disadvantages, such as poor reliability due to mechanical failures, as well known by those skilled in this art.

U.S. Pat. No. 5,240,139 represents a significant improvement in article handling devices. It describes the use of a negative air pressure lifter (i.e., article pickup or handling mechanism), which uses suction, i.e., a reduced or so called "negative" air pressure created by a partial vacuum, for making a secure contact to an article to be retrieved by entering the open top of an article storage bin located in a refrigerated storage area of a vending machine. Although robotic, and specifically suction-type lifting mechanisms are in common use in factory settings, where space limitations are generally relaxed, their use in tight confines, such as an article vending machine, has not gained wide acceptance. Due to the greater reliability and versatility of vending machines of the type which utilizes suction technology for grasping and moving selected articles, it would be desirable to develop new techniques and methods for the operation and control of such machines, as well as for other more generalized article handling mechanisms.

Hose storage is provided in the forenoted U.S. Pat. No. 5,240,139 by use of a longitudinally compressible air hose having about a 3:1 compression ratio. One end of the hose is connected to a source of negative air pressure and another end is connected to an article pickup head. The use of a compressible hose is satisfactory in the environment of U.S. Pat. No. 5,240,139 since the freezer compartment only occupies the lower half of the interior of the vending machine, leaving the upper half available for the hose and its positioning mechanism. However, since the significant part of the expense of operating a vending machine business comprises servicing (i.e. refilling) of the vending machine with products, it would be desirable to be able to provide taller article storage bins, with or without a freezer compartment, in order to maximize the article storage volume within the interior of the vending machine cabinet. Prior art article dispensers typically use between 50 and 60 percent of their available height for article storage.

Due to the above noted disadvantage, it would be desirable to decrease the height requirement for the hose positioning mechanism. One such way would be to consider the use of a non compressible hose. A non compressible hose has the advantage that it can be driven mad/or guided by direct engagement with the walls of the hose, a much simpler technique as compared to the indirect hose positioning technique of the forenoted U.S. Pat. No. 5,240,139. Additionally, a non compressible hose has the advantage of maintaining a constant length in spite of being subjected to changes in vacuum. Even furthermore, a non compressible hose has greater structural integrity and reduced leakage, as compared with for example telescopic tubing. However, two serious problems are presented by the use of a non compressible hose: where can a sufficient length of the hose be stored in order that it's free end can travel the distance from the bottom of the hose positioning mechanism (a position aligned with the top of an article storage bin) to the bottom of the article storage bin; and how can it be simply and reliably be withdrawn and retracted to and from the storage area as needed?

PCT patent publication WO 99/12132 entitled VENDING MACHINE discloses a vending machine having a folded articulated arm for positioning an article gripping suction hose into a freezer for retrieving articles to be dispensed. The hose is non-compressible, and continuous from a base area located beneath the articulated arm to its free end, where it is coupled to an article pickup head. A linear actuator and arm mechanism located in the base area is used to drive the hose into and out of the base area, through the articulated arm and into the freezer compartment. The hose positioning arrangement of this PCT patent publication has a similar disadvantage as the forenoted U.S. Pat. No. 5,240,139, in that a significant volume within the vending machine cabinet is required for the mechanism which positions the hose over and into the storage bins during a package dispensing cycle (i.e., a height almost equal to the height of the article storage bins themselves). Additionally, it is noted that only a relatively small length of hose is required to be stored, corresponding to the amount of hose required to move the article pickup head in the Z direction (i.e., into and out of the freezer), since V significant length of the hose is already stored in the folded articulated arm. Even furthermore, it is noted that this patent publication teaches a relatively complex mechanism for hose positioning, storage and drive.

U.S. Pat. No. 3,977,037 entitled VACUUM CLEANER, U.S. Pat. No. 4,212,421 entitled RETRIEVAL AND STORAGE DEVICE FOR FLEXIBLE ELEMENTS, and U.S. Pat. No. 5,740,581 entitled FREESTANDING CENTRAL VACUUM SYSTEM, are representative of a class of patents which disclose apparatus for retrieving and storing an elongated flexible/compressible element, such as an electrical cord or hose. Generally, after the flexible element is withdrawn from the storage area, a "pinch roller" arrangement is driven so as to retract the flexible element into the hose storage area. Unfortunately, due to the flexibility/compressible in the nature of the flexible element, it's retraction takes place in a relatively haphazard manner and may become entangled during a subsequent withdrawal of the element.

German patent DE 2455673 by G. Lucas, published May 26, 1976 and entitled ENDING MACHINE FOR ICE CREAM-USING SUCTION HEAD TO PICKUP WRAPPED BLOCKS OF ICE CREAM FROM STACK IN REFRIGERATOR discloses an ice cream vending machine wherein a movable carriage is mounted inside a freezer and laterally positionable over the article storage bins. The carriage includes a drive mechanism for lowering an electric cord having a suction motor at its free end into the article storage bins for retrieving the ice cream packages. This type of positioning mechanism for an article handling device avoids the problem of hose storage by actually lowering the suction motor into the bin. It's is particularly disadvantageous since the repeated bending and flexing of the electric cord can lead to reliability/failure problems. Additionally, the diameter of the suction motor places severe limitations upon the dimensions of the article storage bins.

U.S. Pat. No. 5,957,326 entitled APPARATUS FOR RETRIEVING RANDOMLY ORGANIZED ARTICLES, describes a vending apparatus including carriage mounted for being laterally positionable over an article storage bin, and includes a drive mechanism for lowering into the storage bin a pickup head having a plurality of suction cups mounted thereon. Each suction cup is individually connected to a substantial length of hose which leads back to a manifold which supplies suction thereto. This type of positioning mechanism for an article handling device is particularly disadvantageous since the plurality of suction hoses connected to the pickup head are not provided in a hose storage area, and instead are coiled/dragged beneath the carriage during its repositioning thereby protruding significantly into a space which could more advantageously being used for the storage of articles to be vended/dispensed.

U.S. Pat. No. 4,725,186 entitled LIFT TRUCK WITH A VACUUM LOADS SUPPORTING ASSEMBLY discloses a fork-lift type of truck wherein the forks are replaced by a vacuum pad assembly for adhering to and transporting a load. A continuous pneumatic hose is provided between a vacuum pump located at the rear end of the truck and the vacuum pad assembly located at the front end of the truck. In order to accommodate movement of the vacuum pad assembly during handling of the load, a roller and tension assembly is used to form a tension loop in the hose which is intermediate the vacuum pump and the vacuum pad assembly. Although the disclosed arrangement provides a means for preventing entanglements of the hose during its use for transporting articles, it is noted that the environment of this patent does not show or suggested a separate hose storage area, nor an enclosure for storing the articles to be handled.

It would be desirable to provide a storage area which uses less of the interior volume of the article storage enclosure for meeting the hose storage requirements for a hose type of article handling mechanism. Furthermore, it would be desirable to provide such a hose storage area in a relatively simple and reliable manner.

OBJECTS OF THE INVENTION

Accordingly, one of the objects of the present invention is to provide new techniques and methods for the design, operation and control of article handling mechanisms.

It is a further object of the present invention to provide new techniques and methods for the design, operation and control of article handling mechanisms of the type that utilize computer-controlled electromechanical technology, and in the illustrated embodiment a robotically positioned suction-type gripper, for grasping and moving a selected article from one area to another, such as from a storage area to a dispensing area.

It is also an object of the present invention to provide new techniques and methods for such mechanisms, which improve the speed and accuracy of the article handling operation while still handling the articles to be dispensed in a careful manner so as to prevent any damage thereto.

SUMMARY OF THE INVENTION

The above objects are achieved in an illustrated embodiment of an article handling apparatus embodied, for example, as a vending machine, including a controllably positioned hose dispenser for retrieving articles from an article storage area. A hose is continuous from a first end located within a hose storage area, where the hose receives article securing energy (e.g., suction), to a second end adapted to secure to and extract a selected article from the storage area. A hose positioning mechanism coupled to the hose controllably positions the second end of the hose so as to be aligned with a given article stored in the storage area, for controllably contacting and extracting the selected article from the storage area, and controllably positioning the second end of the hose so as to transport the article to a dispensing area. The hose positioning mechanism imparts both a storage requirement and a retraction requirement on the hose as a result of the controllable positioning. In accordance with the principles of the present invention a single hose storage area is provided in the vending machine for meeting all of the hose storage and retraction requirements.

In accordance with a further feature of the invention, the hose positioning mechanism is used to withdraw the hose from the hose storage area, and the hose retraction requirements are met simply and reliably by the use of a retraction mechanism comprising a "gravity-induced", i.e., passive, loop tensioner which is formed in the hose storage area.

In accordance with a further feature of the invention, the single hose storage area is formed as a rectangular volume having a longitudinal axis which does not intersect the longitudinal axis of the article storage area, and in a preferred embodiment, is adjacent to and parallel with a longitudinal axis of the article storage area.

In one embodiment of the invention, the hose comprises a suction sustaining air hose and the article securing energy comprises suction. In a further embodiment the hose can be solid or multi-stranded, and the article securing energy may be electrical or electromechanical, for operating an electromagnet or mechanical claw gripper, respectively.

DETAILED DESCRIPTION OF PREFERRED EMBODIMENTS OF THE INVENTION

Figure 1:
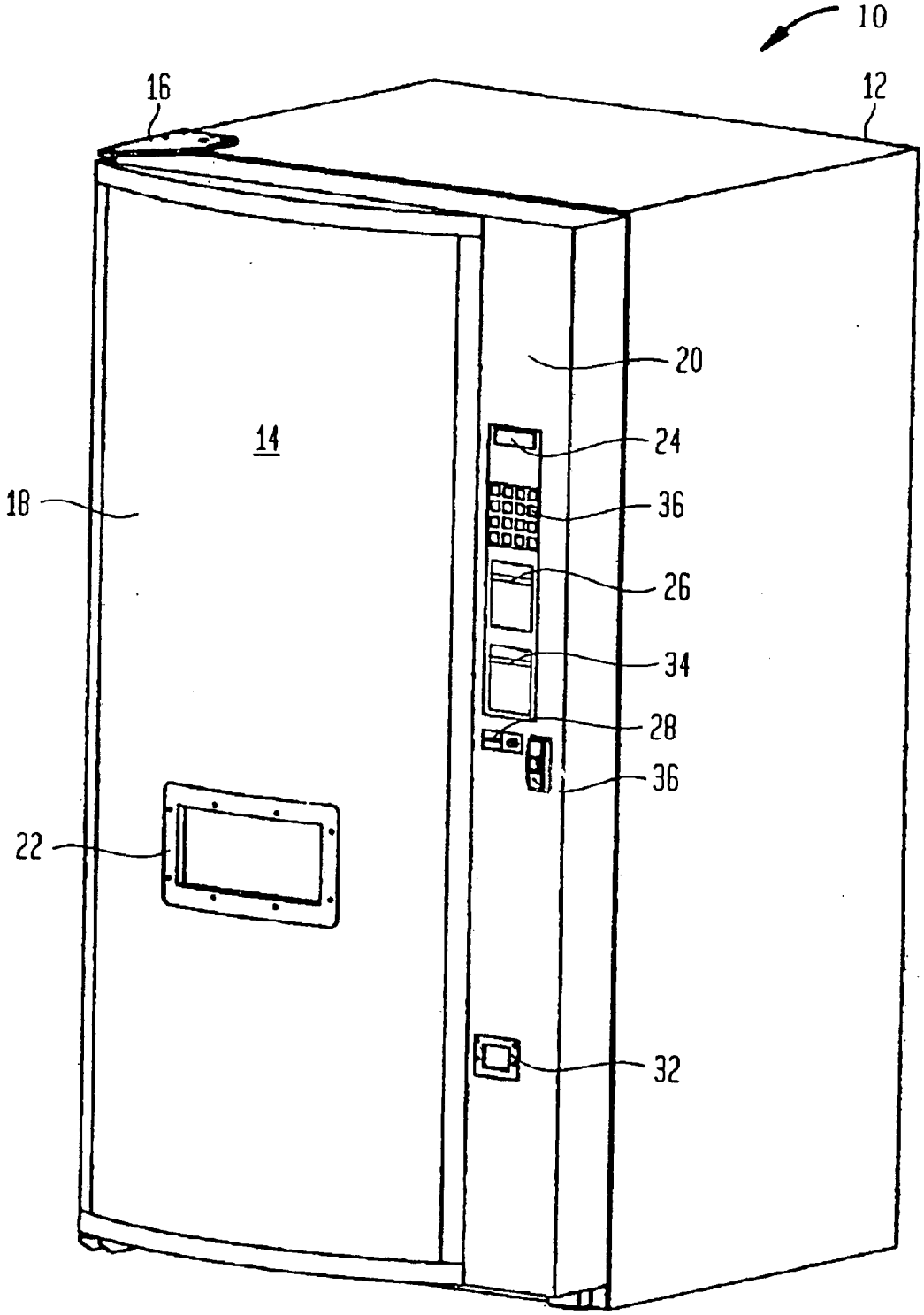
FIG. 1 is a front perspective view of a vending machine constructed and operating in accordance with the principles of the invention

FIG. 1 illustrates an environment for the invention described herein, in the form of an article dispenser, such as a point-of-sale (POS) dispenser. Although throughout the following description, reference is made to implementation of the invention in a vending machine environment, it is intended that the term "vending machine", and in fact the environment for the present invention, include more general purpose article handling, retrieval and/or dispensing apparatus, as well as POS equipment. Such equipment, if embodied as a portable device may comprise and be about the size of a traditional vending machine or as large as a tractor-pulled trailer, and if embodied as a non-portable device may comprise and be embodied as an automated dispensing room or an area located in a permanent structure, such as in a building (aboveground or underground, and with or without interior walls or an enclosing cabinet). Furthermore, it is intended that the term "articles" or "products" include in at least some of the embodiments of the invention described herein, not only goods, but also services and/or information, in either a permanent or temporal form.

Accordingly, FIG. 1 illustrates a perspective view of a vending machine 10, comprising one embodiment for an apparatus which is constructed and operates according to the present invention. Vending machine 10 includes a main cabinet 12 and a front door 14 mounted on a hinge 16 for providing access to the interior of the vending machine for servicing (refilling it with articles, maintenance, etc.). Note, in a further vending machine embodiment, a service door or port could be positioned anywhere on or as a part of cabinet 12. In FIG. 1, front door 14 is shown in a closed position, forming an enclosure with main cabinet 12, within which various components of vending machine 10 are housed, as explained in more detail below.

Front door 14 includes a convex-shaped section 18 adjacent a flat section 20; however, these particular shapes are not necessary to the invention. The convex-shaped section 18 comprises a translucent plastic display panel 18, which typically has brand name and/or logo graphics displayed thereon, and may even include graphics which illustrate the individual articles that are vendible by vending machine 10, as well as the price and/or selection information for the articles. Panel 18 is typically back-light using fluorescent bulbs, not shown.

A customer retrieval area 22 is formed in the panel 18 on door 14 so that articles stored therein can be discharged to a user of vending machine 10.

Various user interface features are mounted on flat section 20 of door 14. A customer display 24 may be a conventional fluorescent or LED display panel for displaying various items of information to a user of machine 10, such as feedback to the user of the selection made, the amount tended, and if the product is sold out or being vended. For accepting payments, a bill acceptor slot 26 accepts paper money into a conventional bill acceptor mechanism (mounted inside machine 10 so as to have its user interface portion extend through an aligned opening in flat section 20) for purchasing articles or for making change. A coin insertion slot 28 accepts coins into a conventional coin changer (also mounted inside machine 10 so as to have its user interface portion extend through an aligned opening in flat section 20) for purchasing articles or for making change. A coin return actuator 30 comprises a conventional push-button mechanism for activating a coin return portion of the coin changer mechanism which, upon actuation returns coins inserted by the current user, to a coin return well 32. The coin return portion of the coin changer mechanism also provides change to the coin return well 32 either in response to the purchasing of articles or for making change for paper money or larger coins. A credit/debit card slot 34 accepts a plastic credit/debit card inserted into a conventional card reader mechanism (also mounted inside machine 10 so as to have its user interface portion extend through an aligned opening in flat section 20) for allowing a user to pay for purchases via credit/debit cards. A door lock mechanism 36 enables front door 14 to be secured so that it cannot be opened without a key. For allowing user selections, display panel 18 may include graphics, as noted above, which indicates the various articles vendible by the machine, as well as their associated price and unique selection number. Alternatively, flat section 20 could include a group of graphic article displays and their associated price. A conventional keypad push-button mechanism 38 is provided for enabling a user to select a desired article from vending machine 10. Alternatively, push-button mechanism 40 could include individual push buttons for each article selection, as well as an associated price display; and even furthermore, a user operated touch screen could replace pushbutton mechanism 40 and display 24. Although not shown in FIG. 1, machine 10 also includes a conventional telecommunications component that can be used for authenticating credit card purchases, as well as other uses relating to machine control and reporting the inventory and operational status of machine 10 to a remote location, as more fully described later on. Although vending machine 10 is illustrated to include the above described user interface components, in a more minimal embodiment of the invention, most, if not all, of these user interface components could be omitted, and the dispenser could in fact be controlled from a remote location, with or without a local payment system.

Figure 2:
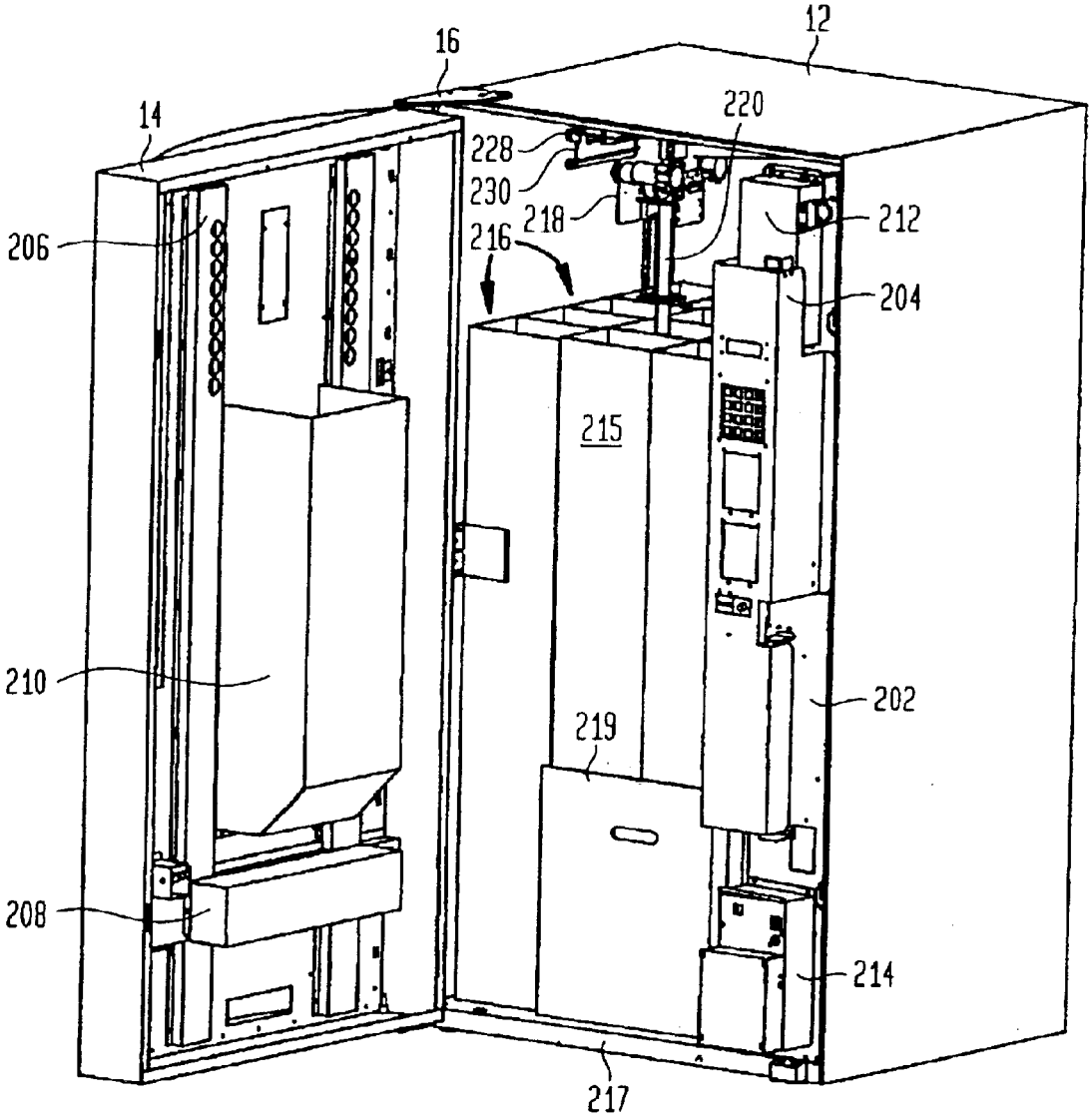
FIGS. 2 and 3 are front perspective views of the vending machine of FIG. 1, with the front door opened, so as to illustrate the main mechanical and electrical components therein, as well as the hose storage area and retraction mechanism constructed in accordance with the principles of the present invention.
Figure 3:
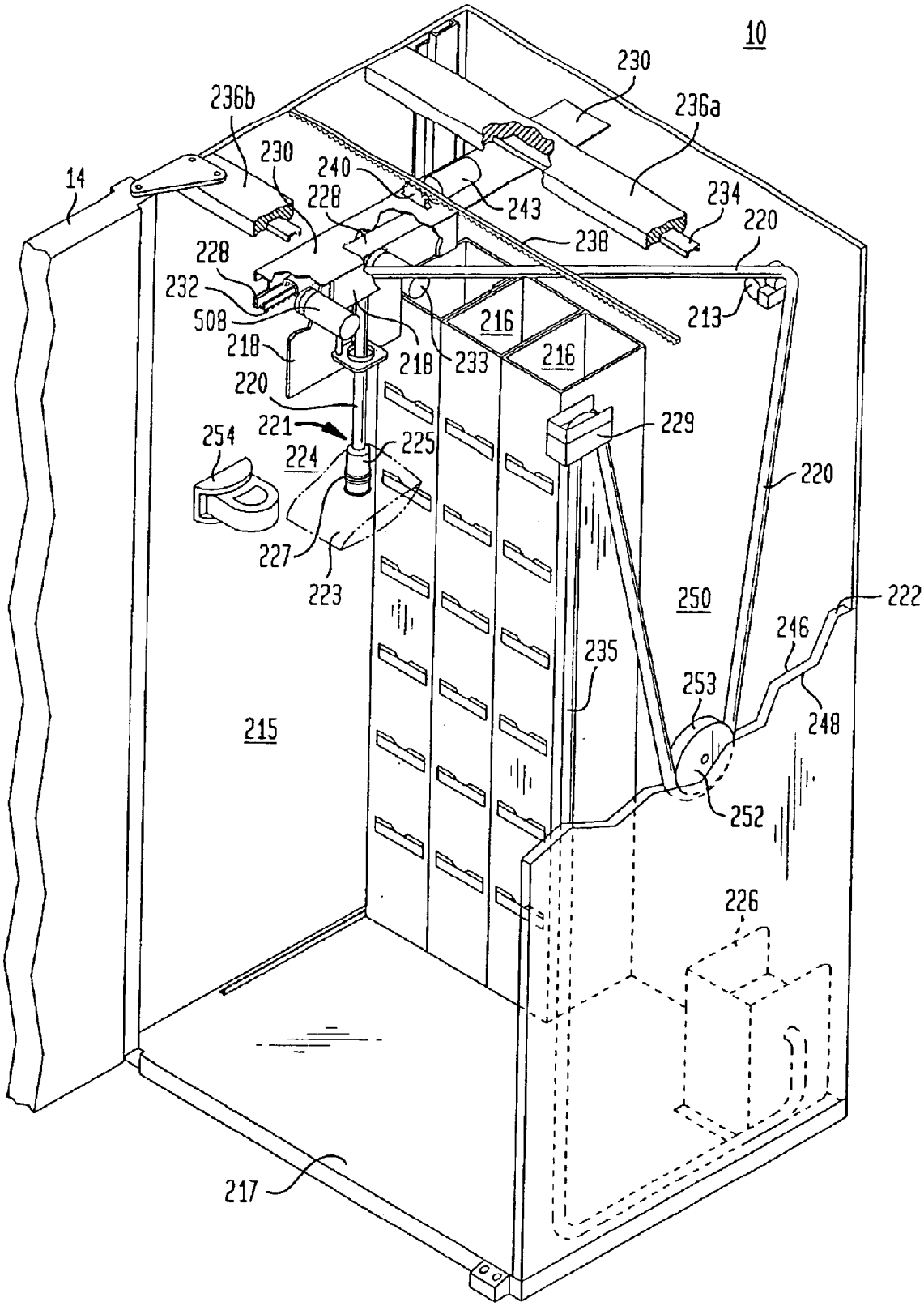

FIG. 2 is a front perspective view of the vending machine of FIG. 1, with the front door open, so as to illustrate the main mechanical and electrical components therein. FIG. 3 is a somewhat idealized version of the main components of the article handling mechanism portion of vending machine 10, and it is useful for understanding its general operation. Note, some portions of vending machine 10 are shown in these FIGURES cut away in order to better illustrate the interior components.

Referring first to FIG. 2, it is noted that the right portion of the front of cabinet 12 includes a vertically mounted support panel 202 which is used for mounting most of the user interface components. More specifically, a hinged mounting bracket 204 is mounted on panel 202 and aligned with an opening in door 14 so that the user interface components, such as the selection button keypad 40, coin insertion slot 30, bill acceptor slot 28, coin return 32, and customer display 24, are all accessible to the user from the front side of door 14. Mounted on the interior of front door 14 are two fluorescent bulb light sources (which are behind protective covers 206. Other numbers of light sources can be used) which emit light for backlighting panel 18. A ballast 208 for the fluorescent bulbs and a product delivery chute 210. Note, the product delivery chute 210 is unconventional in that it is extremely tall, and therefore serves as a security measure to prevent unauthorized access into the machine by insertion of an arm or other grasping mechanism into the customer retrieval area 22 from outside the machine. In typical prior art vending machines, a swinging security door is usually found at the top of chute 210, which swings into a vandal blocking position when the customer pushes in the swinging door at the entrance to the product retrieval area 8. In a further embodiment of vending machine 10, such a security door could be used in conjunction with product delivery chute 210, especially if chute 210 is not as tall as the one illustrated in FIG. 2 and also if the product retrieval area 8 is located higher up on machine 10. Mounted behind hinged mounting bracket 204 is a conventional bill acceptor mechanism for causing paper money inserted into bill acceptor slot 28 to be drawn into vending machine 10, a conventional coin changer supplies coins to coin return slot 34 and is located behind panel a coin guide guides inserted coins into the coin changer, and a conventional bill validator ascertains proper insertion of paper money into bill acceptor slot 28.

A control board 212 comprises a printed circuit board on which circuitry is formed and to which integrated circuit chips are attached. Control board 212 includes a microprocessor that is electrically connected to various sensors, motors, the above described user interface elements, as well as other devices within vending machine 10, to control the operation of vending machine 10 as described herein. When reference is made in this description to performance of specified functions by control board 212, it is to be understood that these functions are controlled by the microprocessor and the associated circuitry formed on control board 212. A power supply 214 is mounted on panel 202 and supplies power for the electrical components of vending machine 10.

Referring now also to FIG. 3, it is apparent that the bulk of the interior of cabinet 12 is available as an article storage area 215. In the illustrated embodiment, a plurality of vertically aligned article storage bins 216 are arranged on the interior floor 217 of cabinet 12, for storing articles 223 to be vended by machine 10. In a refrigerated environment for the present invention the bins could be arranged to sit on a shelf positioned above the refrigeration system. An opened-top container 219 can be dimensioned to hold a plurality of article storage bins 216 therein, and used to facilitate their simultaneous handling (i.e., removal and installation) of the plurality of bins 216 from article storage area 215.

An opened-top container 219 can be dimensioned to hold a plurality of article storage bins 216 therein, and used, for example to facilitate the simultaneous handling (i.e., removal, installation and transportation) of the plurality of bins 216 into/out of the article storage area 215. Container 219 also facilitates rapid and accurate positioning of a plurality of the article storage bins into the storage area of the article handling apparatus. A carriage 218 (which may be more generally referred to as an X-Y or planar positioning mechanism) is coupled to the interior topside of cabinet 12 and adapted for being controllably positioned by the control board portion 212 of machine 10, to a location centered over (so as to be aligned with) the open top-end of a selected one of article storage bins 216.

Although vertical (Z-axis) alignment of the article storage bins 216 is shown, non-vertical, i.e., slanted or even horizontal (X or Y axis) alignment may also be possible (such as found in the well know glass front vending machines of the type using a "spiral wire" type of dispensing apparatus). In the event of substantially horizontal alignment of the storage bins, the planar positioning mechanism will be appropriate changed so as to position carriage 218 for movement in the X/Z or Y/Z plane. In fact, a curvilinear plane, such as a cylinder, is also considered to be within the scope of the present invention. The combination of substantially horizontally aligned stacks of products with a robotically controlled article transport mechanism which moves in a vertical plane adjacent to dispensing ends of the stacks of products, is known, for example in U.S. Pat. No. 6,230,930 issued May 15, 2001 and entitled METHOD AND APPARATUS FOR VENDING PRODUCTS, and in US patent publication US 2001/0000609 published May 3, 2001. Use of a curvilinear plane for article transport is known, for example in the videocassette vending art, wherein the videocassette's are stacked in an outwardly facing manner in a central storage carousel, and a robotic gripper encircles the carousel. Furthermore, although article storage bins 216 are shown to be an ambient environment, bins 216 could in fact the positioned in a refrigerated environment, such as a freezer located in the bottom of storage area 217, and the article transport mechanism enter the bins from a top opening the freezer, such as shown and described in the forenoted U.S. Pat. No. 5,240,139. Alternatively, in the event the refrigerated environment is of the type including a substantially horizontal alignment of the storage bins, a vertically oriented opening could be used to provide access to the dispensing end of the article storage bins.

In the environment of the present invention, an air hose 220 is used to provide an "article securing force" which facilitates securing, grasping and releasing, i.e., handling, by an article pickup head 224 of the articles 223 stored in bins 216. In accordance with one aspect of the present invention, air hose 220 is continuous from a point before it's exit from a hose storage area 222 over orthogonally positioned rollers 213, to its free end 221. Free end 221 includes a weighted portion 225 in combination with a bellows extension tip portion 227. Depending upon the physical characteristics of the articles to be dispensed, article pickup head 224 may comprise only the weighted portion 225, or this portion in combination with a fitting specifically adapted to the type of packages to be dispensed, such as the bellows tip 227 or a compliant tip without a weight. Hose 220 has one end coupled to a source of negative air pressure, i.e., suction, which source of suction comprises in the preferred embodiment a blower motor 226, and a free end coupled to the article pickup head 224. In the present invention, the word continuous is intended to mean a hose which is connected and acts between it's end points, in order to accomplish the functions required by it, as a unitary/single hose. An air hose portion 235 provides suction from blower motor 226 to one port of an air junction box 229, while continuous hose 220 is connected to a second port of air junction box 229. Air junction box 229, included at a top portion of hose storage area 222, includes an airflow sensor and vacuum breaker assembly. The airflow sensor is used to develop a signal which is applied to the controller of the vending machine and is representative of the airflow through air hose 220. The vacuum breaker assembly is used to quickly bring the air pressure in hose 220 to the ambient pressure, thereby facilitating a "quick-release" of an article transported by the article pickup head, into the dispensing chute 210. It is noted that a quick release of the products does not have to occur at the top of dispensing chute 210, and in the event that it is desirable to avoid subjecting the article to forces which result from jarring or dropping, the article pickup head could proceed to the bottom of the dispensing chute 210 before providing the quick release of the article. In one embodiment, the airflow sensor arrangement may comprises a two-part switch, a first part includes a reed switch mounted on a top portion of box 229, and a second part includes a magnet mounted at the free end of a swinging arm mounted inside box 229. As the arm swings inside box 229 due to changes in airflow, the switch is "toggled", thereby indicating changes in airflow. The use of this airflow signal will be described in greater detail later.

Figure 5:
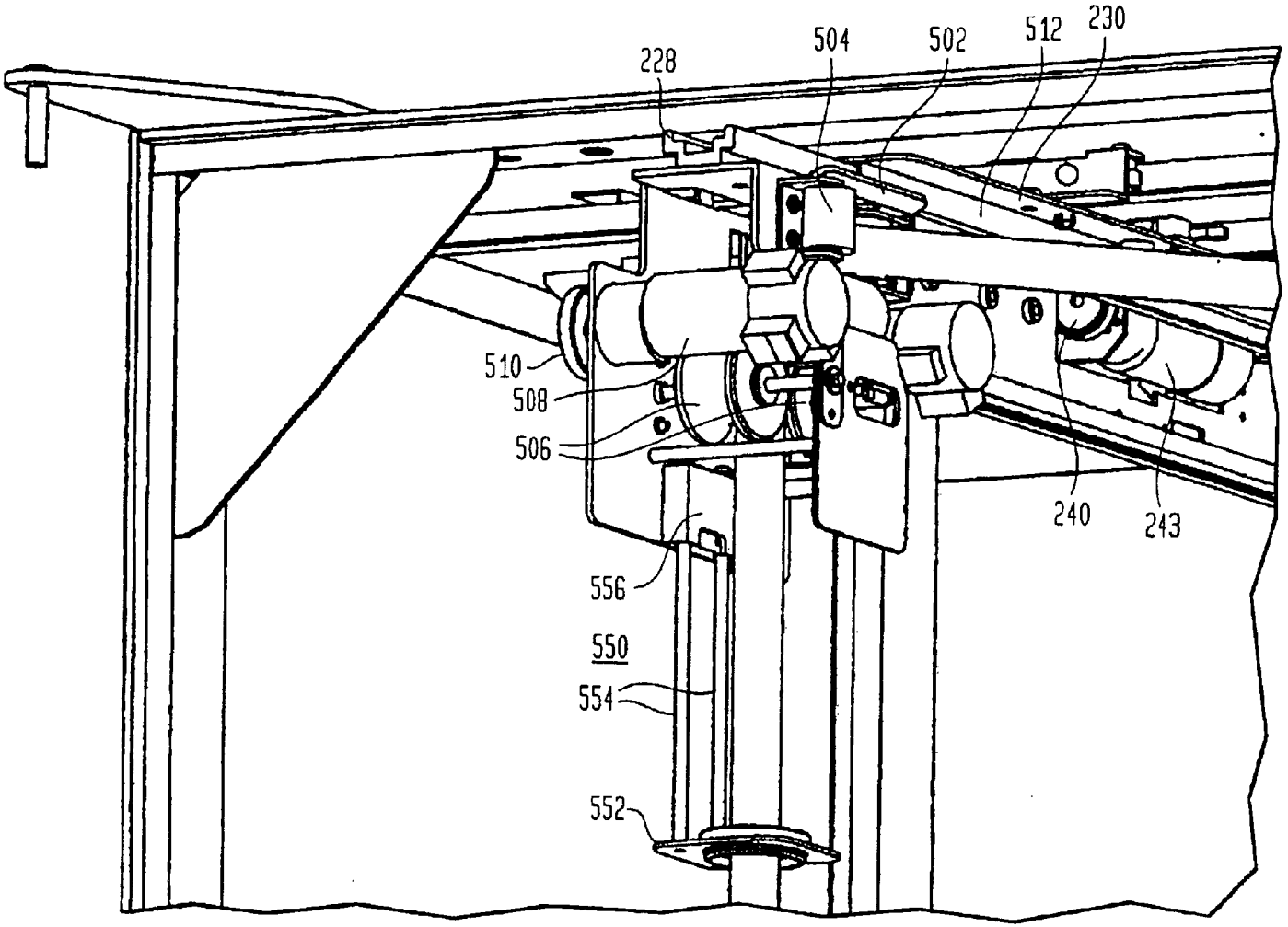
FIGS. 5 and 6 illustrate a right and left perspective view, respectively, of the hose positioning mechanism shown in FIGS. 2 and 3.
Figure 6:
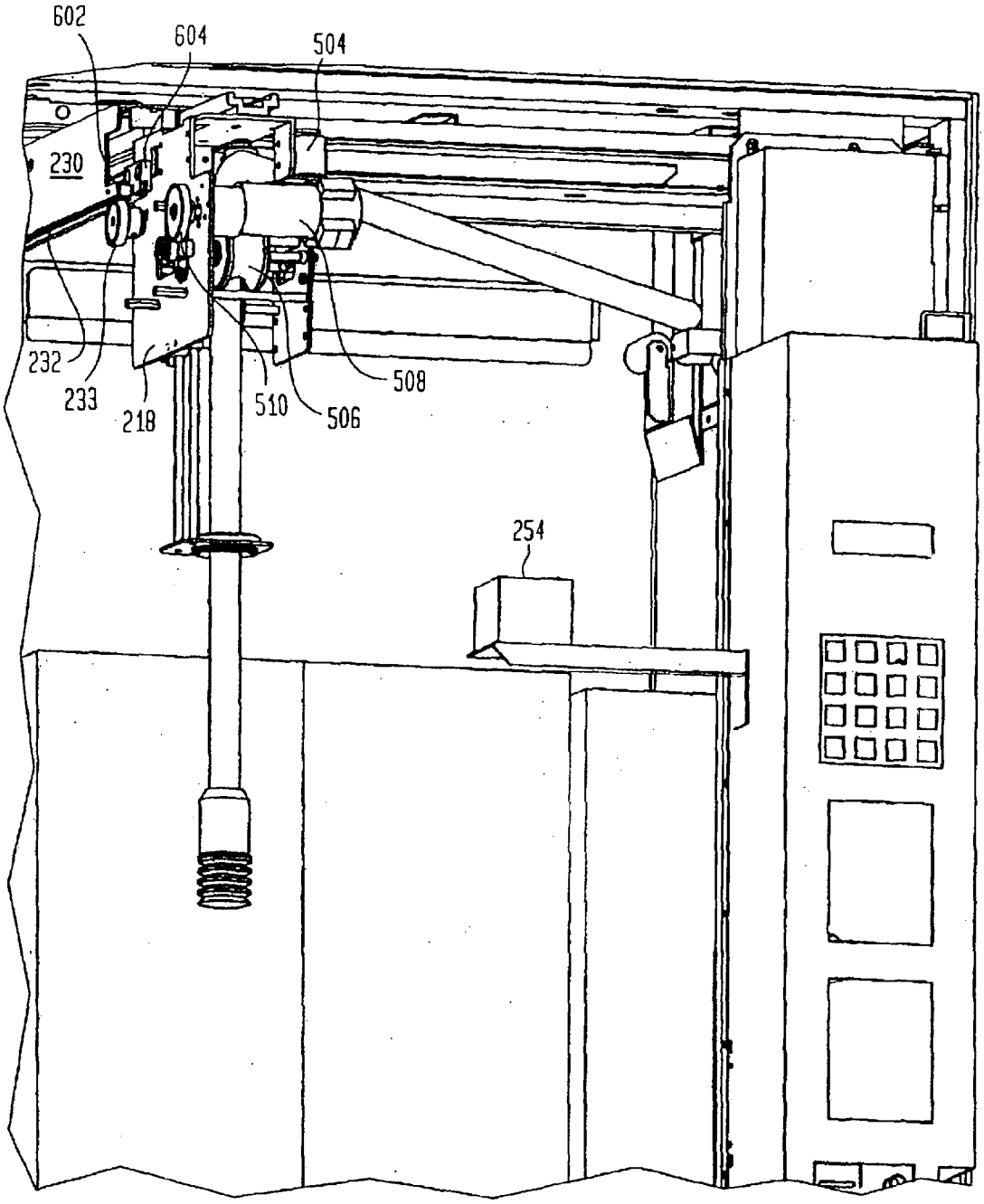

In the environment of the present invention, as shown generally in FIG. 3, and more specifically in FIGS. 5 and 6, a novel hose positioning arrangement is provided for aligning carriage 218 with a selected one of bins 216. This alignment is accomplished in the front/back (Y) direction using a front/back linear slide 228 (shown in a cut away view) mounted to an "L" shaped front/back beam 230 so that carriage 218 can be controllably positioned therealong using slide 228. A bottom edge portion of beam 230 includes a rack portion 232 and carriage 218 includes an electric motor 233 that drives a gear (633 of FIG. 6) which engages rack portion 232. Application of forward and reverse motor control signals from control board 212 to motor 233 causes carriage 218 to be driven in the front/back directions. Alignment of carriage 218 in the left/right (s) direction is accomplished in a similar manner, using a left/right linear slide 234 which slidably couples the top side of front/back beam 230 to the underside of each of spaced art left/right beams 236*a* and 236*b*. Beams 236*a* and 236*b* are rigidly attached to the inside top portion of cabinet 12. A rack 238, also rigidly attached to the top inside portion of cabinet 12 ard in parallel with beams 236, is engaged by a gear 240 driven by a reversible motor 243 mounted near the inside corner of beam 230. Application of forward and reverse motor control signals from control board 212 to motor 243 causes a rotation of gear 240 and a corresponding movement of beam 230, and hence carriage 218, in the left/right (X) directions.

As shown in FIG. 's 2 and 3, as an article 223 is moved by pickup head 224 along its way from a storage bin 216 to chute 210, it is positioned past an article identification (ID) device 254 mounted within cabinet 12. A specific type of article ID device is not required for the present invention, and depending upon system constraints, such a device may comprise, for example, a bar code scanner or other optical image/pattern recognition system, or even a non-optical system, such as a radio frequency identification (RFID), or magnetic-based system mounted within cabinet 12. for uniquely identifying and confirming that the article being dispensed is in fact the article that was selected. The construction operation of such article identification devices are well known to those of skill in this technology, and therefore further description in this regard is not necessary.

Article ID device 254 is mounted within cabinet 12 at a relatively fixed location, the mounting being such that some controlled movement in the orientation of article ID device 254 may be facilitated, in order to help ensure a good "view" of the article being transported, and a high confidence of the transported articles being identified. One way to provide such controlled movement for ID device 254 would be to mount it on a piezoelectric substrate, and control board 212 could provide a voltage to the substrate so as to shift the "view" of ID device 254. It is noted that by using an appropriately positioned article ID device 254, only a single article ID device 254 is needed. This is particularly useful for a robotic type dispenser, since the robotic apparatus can controllably position, and reposition if necessary, the article in the vicinity of the article ID device 254, thereby helping ensure a reliable ID of the article.

Note that although carriage assembly 218 only moves in a single plane, it is responsible for precisely positioning pickup head 224 in each of the X, Y and Z directions. More specifically, as shown in FIGS. 5 and 6, carriage 218 includes a roller arrangement 502 which comprises three orthogonally positioned rollers 504 at the point where hose 220 enters carriage 218, for redirecting the movement of hose 220 from a substantially horizontal direction along the top interior portion of machine 10 (i.e., in the X, Y direction), to a direction perpendicular thereto (i.e., in the Z direction). Movement of carriage 218 will not only move the free end 221 of hose 220 so that it can be axially aligned with a selected one of bins 216, but it will also automatically withdraw hose 220 from the hose storage area 222. Thereafter, a hose drive mechanism which may comprise a set of conventionally operated "pinch rollers" 506 driven by a reversible motor 508 via gear set 510 which are used for driving pickup head 224 into/out of the selected bin 216 in order to retrieve articles stored therein. In the illustrated embodiment the hose drive mechanism is mounted in carriage 218, but in a further embodiment motor 508/rollers 506, or some other drive mechanism, such as the articulated arm shown from the forenoted PCT publication WO 99/12132, could be mounted so as to act somewhere else along the length of hose 220.

This arrangement, where hose 220 travels in the same X, Y plane that carriage 218 travels, facilitates a compact hose positioning and drive mechanism embodiment for the present invention. Furthermore, since movement of the carriage is responsible for supplying most of the force needed to withdraw hose 220 from storage area 222, the Z drive motor is only needed to drive the hose for causing its free end to travel into/out of bins 216 for article retrieval. It is noted that the pinch rollers 506 should comprise a soft rubber material so as to provide a good friction contact to hose 220, and if the hose 220 is corrugated, rollers 506 could have corresponding/matching corrugations. In the illustrated embodiment, it has been determined that two drive rollers are not needed, and accordingly only one of the pinch rollers is driven by motor 508, while a spring (514) is used to urge the other roller towards the driven roller, thereby pinching and driving hose 220 therebetween. Furthermore when using corrugated hose, in some applications it may be possible to replace pinch rollers 506 with a linear screw mechanism adjacent hose 220, for driving the hose.

In the vending machine environment, having a compact hose positioning and drive mechanism is significant. Consider a cabinet having a height of 72 inches: a prior art hose positioning mechanism, such as provided by the forenoted U.S. Pat. No. 5,240,139 or the PCT patent publication WO 99/12132 typically occupied approximately 40 percent of the height dimension inside the cabinet, thereby leaving 60 percent or less for the storage of articles to be vended. With the arrangement of the present invention the hose positioning and drive mechanism comprises less than 25 percent of the interior height of the enclosure, a very desirable result. Additionally, it is noted that the compact hose positioning and drive mechanism of the present invention is extraordinary in that in the illustrated embodiment it occupies approximately only 15 percent of the interior height of the enclosure. What is even more remarkable is that this very compact hose positioning and drive mechanism can position the free end of the hose into alignment with a bird of articles, and then have the ability to drive the hose all way to the bottom of the bin. In the present invention the hose is able to be driven a distance which is greater than three times the height of the hose positioning mechanism and in fact, in the illustrated embodiment the hose is driven approximately five times the height of the hose positioning mechanist A bin holder 260, shown in FIG. 2, comprising a pair of rectangular brackets secured in a spaced manner to opposed interior side walls of cabinet 12, is used to maintain the bins situated therebetween in a predetermined position relative to the interior of the vending machine cabinet. This is required in view of the preprogramming of control board 212 which controls the robotic structure for retrieving a selected article from one a selected one of bins 216.

As previously noted, since hose 220 is formed of a continuous material from its connection to the source of suction at one end to the pickup head 224 at its other end, means are necessary for providing hose storage and/or retraction during travel of the pickup head 224 in the X, Y and Z directions, as appropriate during the article dispensing operations.

As shown in FIG. 3, placing an interior wall 246 parallel and adjacent to an exterior wall 248 of cabinet 12 is used to form the hose storage area 222 there between. Hose storage area 222 has a cross-sectional area which is slightly greater than the cross-sectional area of the hose loop formed therein. Walls 246 and 248 are shown partially cut-away so as to illustrate a gravity feed self-retracting loop tensioner/retraction mechanism 250 formed in hose 220. Loop tensioner 250 is constrained for movement within hose storage area 222, and made somewhat self-retracting by comprising a rolling weight 252 having a groove 253 along its periphery in order to provide constant centering of the weight within hose storage area 222 and for providing a constant, passive "loop forming" tension on hose 220. Furthermore, centering of the grooved rolling weight 252 within hose storage area 222 results in centering of hose 220, thereby preventing hose 220 from rubbing with the walls of hose storage area 222 during X, Y and Z repositioning of pickup head 224. In order to prevent binding of hose 220, rolling weight 252 is dimensioned so as to be slightly larger than the diameter of hose 220 and the width dimension of hose storage area 222 is dimensioned to be only slightly larger than the width dimension of rolling weight 252. The specific amount of weight used for rolling weight 252 is a matter of design choice, and depends upon various factors, such as the weight of the articles to be moved, the strength of the motors used to drive the hose in the Z direction, etc. In a further embodiment, it may be desirable to couple weight 252 to a lower portion of cabinet 12 using a spring, for adding further tension to loop tensioner 250.

It is also noted that this gravity-based retraction/hose storage technique sets the storage requirements needed for both the X and Y movements of carriage 218 (left/right and front/back), as well as for the Z movement of pickup head 224. Of course this gravity-based retraction/hose storage technique would work equivalently well in an embodiment wherein the robotic hose positioning mechanism used a rotary type device (R, □), an articulated arm, telescoping or scissor system, or other technique. Furthermore, the illustrated gravity-based retraction/hose storage technique is not necessary for some embodiments of the present invention, and in fact a fully or partially motorized retraction technique could also be used. Furthermore, in other embodiments, it may be desirable to place hose storage area at another location, such as parallel to the top or rear portion of cabinet 12. In the event it is in the top portion of cabinet 12, the passive, gravity based retraction described above would not be appropriate, and instead an active system would be needed, such as one with a motorized retractor.

Even furthermore, although only a single storage area 215, hose 220 and carriage 218 are shown in the illustrated embodiment, the invention described herein could also be used in a dispensing apparatus/article handler of the type having multiple storage areas and/or robotic article handling mechanisms, such as two robotic mechanisms (vertically or horizontally positioned) each one serving, for example, a different storage area (such as one being refrigerated and one being non-refrigerated, or one being oriented for vertical storage of products and the other one for horizontal). In this case a separate hose, hose positioning mechanism and hose storage area may be required, although they may possibly share a single source of suction (e.g., blower motor 226), airflow sensor and vacuum breaker. Alternatively, a single hose, hose positioning mechanism and hose storage area could be used in a further embodiment where the single hose services more than one article storage area. Each robotic article handling mechanism could have its own article ID service, or they could share a single article ID device.

In the embodiment illustrated herein, blower motor 226 provides a relatively high volume of airflow but a relatively modest negative bit pressure. As a matter of design choice, blower motor 226 could comprise a vacuum pump, so as to provide a much more substantial degree of negative air pressure, but, due to size and cost limitations, a correspondingly reduced amount of airflow. In this latter case, the diameter of the air hose 220 would be reduced from the diameter illustrated in FIGS. 2 and 3, which may be particularly important in some applications of the present invention. The illustrated embodiment is particulary useful for picking up flexible packages since a momentary or even sustained leak in the coupling to the packaging to the article will generally not result in dropping of the package, while at the same time offering extreme versatility due to the ability to pick up a wide variety of shaped objects of varying weight and size. In the event that blower motor 226 comprises a vacuum pump, it could be used alone or in combination with a storage tank coupled to the suction hose via a valve and air hose, in order to provide a greater volume of airflow. Alternatively a compressor could be used in combination with a venturi device to create a vacuum.

Alternative embodiments for the robotic hose positioning mechanism described above are contemplated to be within the scope of the present inventions. For example, instead of using a combination of left/right slides 234 and support beams 236*a* and 236*b*, a roller/guide rail combination could be used. Support beams 236*a* and 236*b* may comprise a support plate having two outwardly facing, i.e., opposed, L-shaped rails, along its edges. The function of slides 234 could be accomplished by fixing a pair of brackets to opposed ends of beam 230, each bracket including a pair of spaced apart and inwardly facing rollers which engage and follow the opposed rails on the support plate. Furthermore, the spaced apart and inwardly facing rollers could each comprise a set of rollers positioned to be angled 90 degrees with respect to each another, so as to engage or follow the two orthogonal surfaces of the L-shaped rails. Such arrangement may result in a coupling of carriage 218 to beam 230 which needs less adjustment for proper operation. Furthermore, as previously noted, the event of substantially horizontal alignment of the storage bins, the robotic hose positioning mechanism can position carriage 218 for movement in a vertical plane which is substantially flat (i.e., in the X/Z or Y/Z plane) or in fact a vertical curvilinear plane. Additionally, as previously noted, in some aspects of the invention, it may be desirable for the robotic hose positioning mechanism to include a rotary device (R, □) of the type including an I beam of fixed length (or telescopic sections), for establishing the "R" movement of the gripper/pickup heads which pivots for establishing the "□" movement. Alternatively, in other environments for the invention the robotic hose positioning mechanism may include an articulated arm or scissor system, or other technique.

Figure 4:
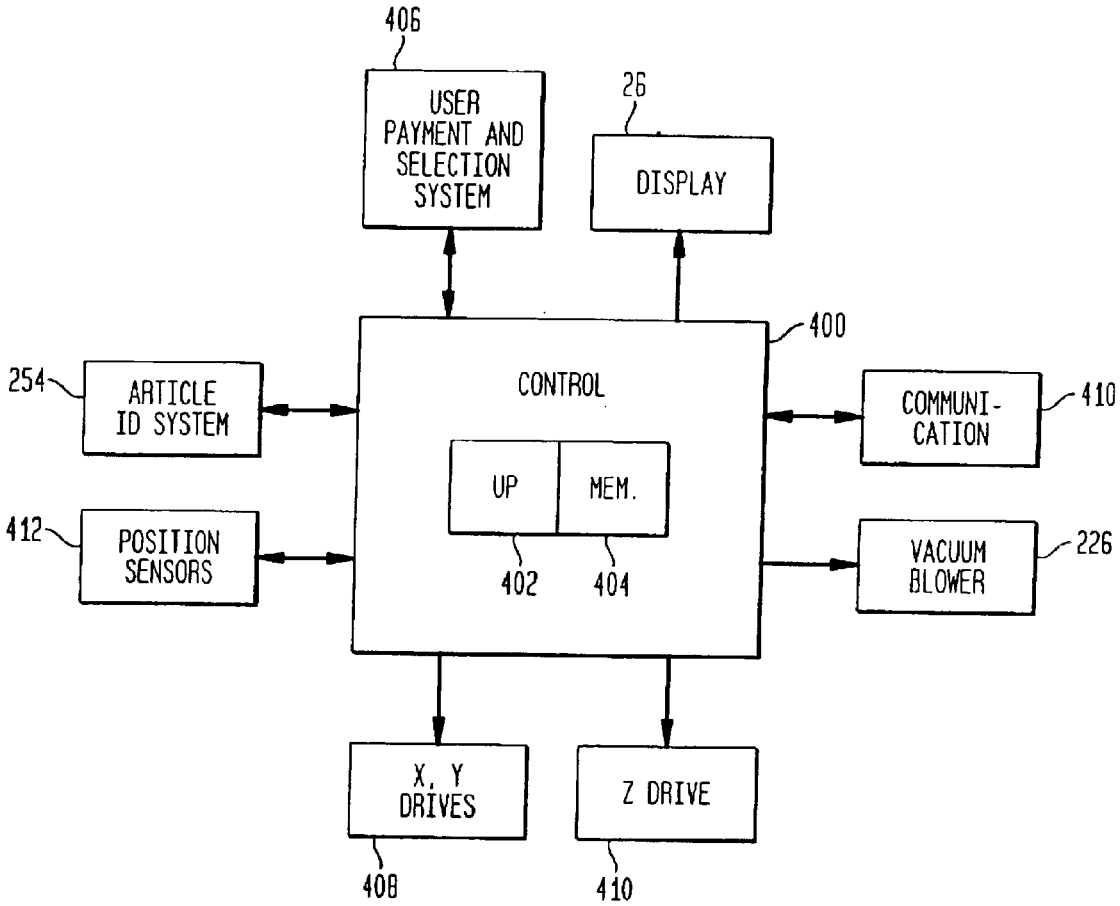
FIG. 4 is a functional block diagram illustrating the cooperation of the main mechanical and electrical components in the vending machine of FIG. 1.

FIG. 4 illustrates a functional block diagram of the general operation of the various aspects of the invention described herein, as embodied in an article dispenser of the type comprising, for example, vending machine 10. A control system 400 including a microprocessor 402 and associated memory circuits 404, is constructed on control board 212. Control system 400 may also include the electronic parts of other portions of vending machine 10, as appropriate. Memory circuits 404 include ROM for storage of operating programs (embedded software, as well known, for accomplishing the described herein control of vending machine 10), as well as RAM cache for temporary storage of operational data during system operation as well as other data as may be needed. Control system 400 is responsive to user operation of the user payment and selection system 406

(including the coin and bill mechanism 28 and 30 and the selection buttons 40 of FIG. 1) for operating the user interface and article handling apparatus of vending machine 10 so as to dispense the article desired by a user. More specifically, upon proper payment for a selection made by the user using payment and selection system 406, control system 400 operates the X(Y (left/right and front/back) drive motors 233 and 243 so as to position pickup head 224 to be in alignment with a bin 216 which holds the article selected by the user. Control system 400 then engages a hose drive motor 508 (Z-motor) mounted within and carried by carriage 218, so that hose 220 is driven in a direction towards the top article in the aligned bin. At an appropriate time before head 224 contacts the article to be removed (and in an embodiment of the invention where cabinet 12 does not include refrigerated air, an appropriate time may be just before head 224 enters bin 216, but if the air is refrigerated, just before contact with the desired article is expected, in order to minimize removal of refrigerated air), control system 400 activates blower motor 226 so as to provide lifting suction at pickup head 224. Upon position sensors 412 determining that pickup head 224 has contacted and become secured to the desired article, control system 400 causes hose drive motor 410 to reverse its direction so as to retract hose 220 from the aligned bin 216 and thereby lift out from the bin 216 the selected article. Carriage 218 is then driven to a position in alignment with the article delivery chute 210.

Upon sensors 412 sensing alignment of carriage 218 with chute 210 (in this case sensor 412 may comprise a reed switch mounted on a front wall of the cabinet, and a magnet mounted at a leading edge of carriage 218), control system 400 turns off blower motor 226 and the resulting loss of vacuum causes the selected article to drop into the customer retrieval area 22. As previously noted, in the event that the articles are so fragile that they should not be dropped or subjected to such impact forces, hose 220 can be driven to the bottom of chute 210 before the article is released.

It is noted that position sensor 412 may include the airflow sensor of junction box 229, or in a further embodiment, comprise a mechanically operated plunger-type position sensor associated with pickup head 224. Even furthermore, position sensors 412 may also include a reed switch mounted on a front wall of the cabinet, and a magnet mounted at a leading edge of carriage 218.

In accordance with a further aspect of the present invention, since the control system keeps track of the movement of hose 220 and carriage 218 (for example, by sensing pulses from a shaft encoder or other distance measuring device on each of their respective drive motors), the signal generated by the airflow sensor at the time carriage 218 reaches the virtual home can also be used as a check to ensure that control system 400 accurately counted the motor drive pulses, and can re calibrate the positioning system based on the virtual home, if necessary.

A communication system 414 is connected to control system 400 so as to provide article inventory and vending machine operation information to a remote location, as well as to allow for control of the operation of the vending machine from a remote location. In this regard, communication system 414 may include a connection to means for making a wire-line and/or wireless transceiver interface through which a communication link with a remote computer can be established. Additionally, the communication system 414 may communicate with a plurality of other similarly connected vending machines in the same general area and communicate therewith using the wire-line interface or wireless communication. Even furthermore, communication system 414 can provide for communication with multiple vending machines and/or a local server/controller, in a local site along a LAN (local area network), LAWN (a local area wireless network) or a WAN (wide area network). The remote computer may comprise a database which receives and/or accumulates the operational data from one or more vending machines, which data is then accessible (via, e.g., the Internet, using a wired or wireless connection) using appropriate encryption, to others, such as route drivers, machine operators, machine owners, product suppliers, etc. Furthermore, the remote site may give feedback to the vending machines, such as authorization information, which can control its operation, such as allow its continued operation.

While this invention has been particularly shown and described with references to preferred embodiments thereof, it will be understood by those skilled in the art that various changes in form and details may be made therein without departing from the spirit and scope of the invention as defined by the appended claims. In fact, many such changes are already noted in this description. Those skilled in the art will recognize, or be able to ascertain using no more than routine experimentation, many equivalents to the specific embodiments of the invention described specifically herein.

For example, although a suction providing air hose 220 has been disclosed in the described preferred embodiments, in fact a solid element having a gripper at its free and, such as a mechanically operated claw (or an electromagnetic device or even a self-contained suction generator), could also be used. Such equivalents are intended to be encompassed in the scope of the appended claims.

What is claimed is:

1. A vending machine, comprising:

a cabinet, a article storage area locked in the interior volume of the cabinet;

a suction hose formed of a substantially continuous material having one end for extracting articles from said storage area and another end connected to a source of suction;

a hose positioning mechanism coupled to said suction hose between said one and said another end, for controllably positioning said one end so as to be aligned with a longitudinal axis along which a given article is stored in said storage area, and hose drive means co-located with said hose positioning mechanism for controllably driving said hose in a direction aligned with said longitudinal axis so said one end can extract a article from said storage area, wherein said hose positioning means and said hose drive means both impart storage requirements on said suction hose as a result of said controllable positioning and controllable driving of said hose, and wherein a single hose storage area is provided in said vending machine for meeting said hose storage requirements.

2. The vending machine of claim 1, wherein said hose storage area is located inside said cabinet and adjacent to said article storage area.

3. The vending machine of claim 1, wherein said single hose storage area is located parallel to an inside wall of said cabinet.

4. The vending machine of claim 1, wherein said single hose storage area comprises a vertically oriented space located parallel to an inside wall of said cabinet.

5. The vending machine of claim 1, wherein said hose storage area includes a gravity induced loop of said hose, coupled between a source of suction and a point where said hose exits said hose storage area towards said hose positioning means.

6. The apparatus of claim 5, wherein the gravity induced loop includes a deadweight roller which rolls on a loop of hose in the hose storage area, thereby providing a relatively constant amount of hose retraction force.

7. A vending machine, comprising:

a cabinet, an article storage area located in the interior volume of the cabinet;

a vacuum hose formed of a substantially continuous material having one end for extracting article from the storage area and another end connected to a source of vacuum;

a hose positioning mechanism coupled to the vacuum hose between the one and the another end, for controllably positioning the one end so as to be aligned with a longitudinal axis along which a given article is stored in the storage area; and hose drive means for controllably driving the hose in a direction aligned with the longitudinal axis so the one end can extract an article from the storage area, wherein the hose positioning means and the hose drive means both impart retraction and storage requirements on the vacuum hose as a result of the controllable positioning and controllable driving of the hose, and wherein a single hose retraction mechanism and storage area is provided in the vending machine for meeting said hose retraction and storage requirements.

8. The vending machine of claim 7, wherein said hose storage area is located inside said cabinet and adjacent to said article storage area.

9. The vending machine of claim 7, wherein said single hose storage area is located parallel to an inside wall of said cabinet.

10. The vending machine of claim 7, wherein said single hose storage area comprises a vertically oriented space located parallel to an inside wall of said cabinet.

11. The vending machine of claim 7, wherein said hose storage area includes a gravity induced loop of said hose, coupled between a source of suction and a point where said hose exits said hose storage area towards said hose positioning means.

12. The apparatus of claim 11, wherein the gravity induced loop includes a deadweight roller which rolls on a loop of hose in the hose storage area, thereby providing a relatively constant amount of hose retraction force.

13. An article retrieving apparatus, comprising:

a storage volume for storing articles along a plurality of longitudinal axes;

an article extracting device having a free end for selectively extracting an article from the storage volume;

a positioning mechanism coupled to the article extracting device and responsive to control signals for moving the free end of the article extracting device to be in alignment with a selected one of the longitudinal axes;

a drive mechanism coupled to the article extracting device for moving the free end of the article extracting device in a direction aligned with the longitudinal axes in the storage area; and control apparatus coupled to the positioning mechanism and the drive mechanism for causing controlled movement of the article extracting device so that a selected article is extracted from the article storage area and moved to a predetermined area of the retrieving apparatus, wherein:

said article extracting device is formed of a continuous flexible member which has a substantially fixed length from its free end to a point inside a flexible member supply volume where said flexible member is coupled to a source of article securing energy;

the positioning mechanism and the drive mechanism each impart a requirement of variable length on the flexible member from its free end to a point where it enters said flexible member supply volume, as a result of the controllable positioning and controllable driving, respectively, thereof; and at least a portion of the variable length requirements imparted on the flexible member by each of the positioning mechanism and the drive mechanism are met by extraction and retraction of the flexible member from a supply of said flexible member stored in said flexible member supply volume.

14. The article retrieving apparatus of claim 13, wherein:

the article retrieving apparatus is positioned in a cabinet of a vending machine, the flexible member comprises a hose, and the source of article securing energy comprises a source of suction.

15. The vending machine of claim 14, wherein said hose storage area is located inside said cabinet and adjacent to said article storage area.

16. The vending machine of claim 14, wherein said single hose storage area is located parallel to an inside wall of said cabinet.

17. The vending machine of claim 14 wherein said single hose storage area comprises a vertically oriented space located parallel to an inside wall of said cabinet.

18. The vending machine of claim 14, wherein said hose storage area includes a gravity induced loop of said hose, coupled between a source of suction and a point where said hose exits said hose storage area towards said hose positioning means.

19. The apparatus of claim 18, wherein the gravity induced loop includes a deadweight roller which rolls on a loop of hose in the hose storage area, thereby providing a relatively constant amount of hose retraction force.

* * * * *